US005219371A

United States Patent [19]

Shim et al.

[11] Patent Number: 5,219,371

[45] Date of Patent: Jun. 15, 1993

[54] DRY CLEANING SYSTEM AND METHOD HAVING STEAM INJECTION

[76] Inventors: Kyong S. Shim, 20530 Anza Ave., #126, Torrance, Calif. 90503; Sun J. Hwang, 4109 E. Townsend Ave., Orange, Calif. 92667

[21] Appl. No.: 858,701

[22] Filed: Mar. 27, 1992

[51] Int. Cl.[5] ..... D06F 43/02; D06F 43/08

[52] U.S. Cl. ..... 8/149.1; 8/158; 34/32; 34/133 B; 68/5 C; 68/18 R; 68/20

[58] Field of Search ..... 8/149.1, 158; 68/5 C, 68/18 R, 18 C, 20; 34/26, 32, 72, 133 B

[56] References Cited

U.S. PATENT DOCUMENTS

| | | | |
|---|---|---|---|
| 1,675,160 | 6/1928 | Carroll | 68/5 C |
| 3,065,617 | 11/1962 | Fuhring | 68/18 R X |
| 3,234,571 | 2/1966 | Buss | 68/5 C X |
| 4,207,683 | 6/1980 | Horton | 34/133 B X |
| 4,262,430 | 4/1981 | Janson et al. | 68/18 C X |

FOREIGN PATENT DOCUMENTS

| | | | |
|---|---|---|---|
| 769398 | 10/1967 | Canada | 68/18 C |
| 649785 | 1/1951 | United Kingdom | 68/18 C |

*Primary Examiner*—Philip R. Coe
*Attorney, Agent, or Firm*—Roy A. Ekstrand

[57] ABSTRACT

A dry cleaning system and method includes having a rotatable basket therein for receiving to-be-cleaned clothing articles. A fluid circulating system provides for the circulation filtering and cleaning of dry cleaning solvent through the cleaning basket and clothes therein. An air circulating system includes a motor driven fan together with a solvent recovery station utilized to pass heated air through the basket and clothing therein to extract the solvent therefrom. A steam injection system is periodically operated during the drying and reduction portions of the dry cleaning cycle to improve the efficiency of solvent recovery and increase the effectiveness of the dry cleaning system.

13 Claims, 2 Drawing Sheets

DRY CLEANING SYSTEM AND METHOD HAVING STEAM INJECTION

FIELD OF THE INVENTION

This invention relates generally to dry cleaning apparatus and methods and particularly to those directed toward reduced environmental impact from dry cleaning operations.

BACKGROUND OF THE INVENTION

Dry cleaning establishments have become extremely commonplace throughout most of the industrialized nations of the world and have, for many years, provided valuable services in cleaning, sanitizing and restoring the usefulness of many fabrics and clothing garments which are not suitable for laundering operations. While the specific structures used in such dry cleaning operations vary somewhat with design, generally all utilize a closed drum having a rotatable tumbling basket disposed therein for receiving a quantity of clothing articles or the like for dry cleaning. The drum is equipped with an access door which is closed and preferably sealed during cleaning operations. The basic cleaning cycle involves the introduction of cleaning solvent into the drum and basket which is circulated through various filters as the tumbling basket is agitated or rotated to tumble the clothing articles through the solvent. At some point, usually under the control of a master timer, the solvent is extracted in a cycle which culminates in a high speed spin operation. Thereafter, a drying cycle is carried forward in which heated air is circulated through the basket and clothing articles. Often, the heated air used in drying is repeatedly heated prior to passing through the clothing articles and cooled thereafter to condense solvent out of the air and then reheated prior to the next circulation through the drying clothing articles. Once the drying cycle is complete, a reduction or cool down cycle is carried forward afterwhich the dry cleaning operation is complete.

When originally employed, such dry cleaning operations were relatively free of environmental concerns and regulations. Thus, in many early dry cleaning machines, the circulated air was simply vented to the atmosphere to carry away the solvent during the drying operation. However, recent environmental laws and regulations have imposed very strict constraints upon dry cleaning operations. In general, these regulations and laws have mandated the use of closed systems which do not vent solvent into the atmosphere generally. In addition, the environmental laws and regulations have essentially made necessary more efficient solvent recovery throughout the entire dry cleaning operation. The objective in addition to concerns over directly vented air into the atmosphere has also focused upon minimizing the solvent vapor vented between operations during unloading and loading as well as minimizing the amount of solvent residual remaining in clothes articles at the completion of the dry cleaning cycle. Many of the regulations and laws recently enacted have the stated purpose of reducing the solvent contaminants in the environment to avoid damage to the health and well being of laborers operating such machines. These regulations have an additionally stringent aspect to them in that the dry cleaning establishment environment often includes multiple dry cleaning machines as well as substantial quantities of recently cycled clothing articles awaiting pickup and removal.

Thus, measurements directed to the total solvent content within the air at the cleaning facility essentially monitor the cumulative effect of many solvent sources.

While present available dry cleaning systems if properly operated may, in most instances, meet the present environmental and workplace safety regulations, they do so only if properly maintained and operated and optimally constructed. In view of the clear trend of environmental laws and regulations as well as workplace safety laws toward evermore strict and demanding requirements, it appears to be clear that present day dry cleaning systems will not be capable of meeting such stricter laws and regulations. Thus, there remains a continuing need in the art for evermore environmentally acceptable and safe to operate dry cleaning systems.

SUMMARY OF THE INVENTION

Accordingly, it is a general object of the present invention to provide an improved dry cleaning system and method. It is a more particular object of the present invention to provide an improved dry cleaning system and method which more efficiently and thoroughly recover the cleaning solvent from the system's air and clothing articles being cleaned.

In accordance with the present invention, there is provided a dry cleaning system for use in dry cleaning cloth articles, the dry cleaning system comprises: a cloth article drum having a movable basket therein; solvent circulation means for circulating a solvent through the drum; air circulation means for circulating air through the drum; and steam injection means for intermittently injecting steam into the drum at predetermined times when the air circulation means is operating.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
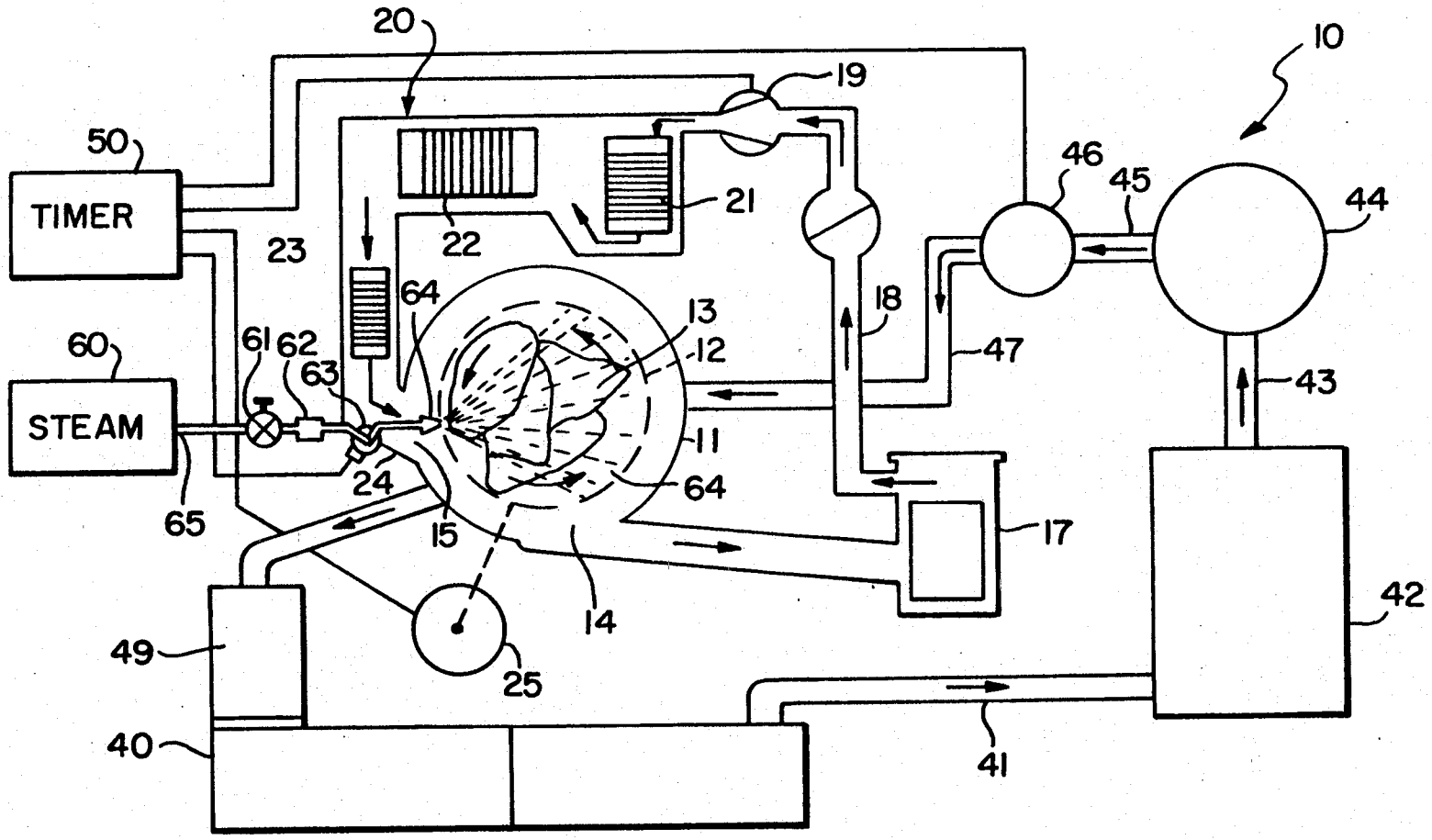
FIG. 1 sets forth a block diagram of a dry cleaning system constructed in accordance with the present invention.

FIG. 1 sets forth a block diagram of a dry cleaning system constructed in accordance with the present invention and generally referenced by numeral 10. Dry cleaning system 10 includes a large hollow drum 11 within which a mesh or foraminous basket 12 is rotatably supported by conventional support mean (not shown). A basket motor 25 comprising a conventional electric motor is operatively coupled to basket 12 such that basket 12 is rotated when motor 25 is energized. Drum 11 further defines an inlet portion 15 and an exit portion 14 forming respective parts of the air circulating system. A return duct 16 couples exit portion 14 to a conventional button trap 17. Button trap 17 is intended to provide a convenient drop basket within which buttons and other heavy articles inadvertently separated from the clothing within basket 12 are retained due to their substantial weight. Button trap 17 is coupled by an air duct 18 to a motor driven fan 19. Motor driven fan 19 is constructed in accordance with conventional fabrication techniques and provides 10 an air flow from button trap 17 into a solvent recovery station 20. In accordance with conventional fabrication techniques, solvent recovery station 20 includes a plurality of operative elements within the stream of fan driven circulating air which include a condensing coil 21, a heat pump coil 22 and a steam coil 23. A duct 24 couples solvent recovery station 20 to inlet 15 of drum 11 completing the air circulation path for dry cleaning system 10.

In addition to the air circulating system shown in FIG. 1, dry cleaning system 10 also includes a solvent circulating system. Thus, a solvent reservoir or base tank array 40 is coupled to a distilling unit 42 by a circulating pipe 41. The output of still 42 is coupled to a solvent filter 44 by a pipe 43. A solvent pump 46 is coupled to filter 44 by an input pipe 45 and is coupled to the interior of drum 11 by a pipe 47. A return pipe 48 is also coupled to drum 11 and to a water separating unit 49. The latter is further coupled to solvent reservoir 40.

Thus, a solvent circulating system is provided by solvent pump 46, filter 44, distilling unit 42 and water separator 49 together with the interconnecting coupling pipes which draws cleaning solvent from reservoir 40 processes it and circulates it through drum 11 to perform the above-described cleaning action. It will be apparent to those skilled in the art that the circulating systems shown in FIG. 1 are generalized and substantial variation of the relative locations within the circulating streams of each system may be changed without departing from the spirit and scope of the present invention and thus the systems shown are merely exemplary and should not be construed as limiting in any fashion.

In accordance with an important aspect of the present invention, dry cleaning system 10 further includes a steam injection system having a source of heated steam 60 constructed in accordance with conventional fabrication techniques for producing high pressure heated steam. Steam source 60 includes an output 65 which is coupled to a steam injection valve 63 by the series combination of a manual shut-off valve 61 and a filter 62. Injection valve 63 is further coupled to a steam injection nozzle 64 which extends into the interior of drum 11.

A cycle timer 50 includes conventional cycle timing apparatus and is coupled to motor driven fan 19, solvent pump 46, basket motor 25 and injection valve 63. Thus, timer 50 is, in its preferred form, a programmable timer which permits controlled operation of the various components within dry cleaning system 10 to provide the method of operation set forth below in FIG. 2 in greater detail. However, suffice it to note here that timer 50 provides the basic control for the operation of dry cleaning system 10 through the desired cycle.

In operation, a quantity of clothes articles 13 are introduced into drum basket 11 by the operator. Thereafter, timer 50 is activated to commence a dry cleaning cycle. Initially, timer 50 energizes basket motor 25 to tumble or otherwise agitate basket 12 while simultaneously energizing solvent pump 46. As clothing articles 13 tumble or are otherwise agitated within basket 12 of drum 11, solvent pump 46 circulates cleaning solvent from reservoir 40 to distilling unit 42 and thereafter through filter 40 to solvent pump 46. Still 42 provides a distilling operation upon the solvent circulated therethrough which in accordance with conventional distillation processes purifies the solvent and removes a variety of contaminants and undesired water or the like. Filter 44 provides a particulate matter separation to further purify the circulating solvent prior to its introduction into drum 11 and its circulation through clothing articles 13. The circulating cleaning solvent returns to reservoir 40 through a return pipe 48 from drum 11 and is passed through a water separator 49 prior to return to solvent reservoir 40. Water separator 49 operates as the name indicates to remove and separate any water within the circulating fluid prior to its return to reservoir 40.

This solvent fluid circulation and tumbling action continues for a predetermined cycle time set within programmable timer 50. Once timer 50 has timed out on this portion of the cleaning cycle, timer 50 ceases the operation of solvent pump 46 and activates basket motor 25 in accordance with the high speed spin extraction portion of the cycle. During the spin extraction portion of the cleaning cycle, basket 12 is rotated at a greatly increased speed forcing clothing articles 13 outwardly against the interior surfaces of basket 12. As the spin extraction continues, the centrifugal force produced operates to draw a substantial portion of the solvent remaining within the clothing articles. This additionally extracted solvent is returned to reservoir 40 through water separator 49. Once the spin extraction cycle is complete, timer 50 ceases the spin cycle and initiates the cycle portion dedicated to drying clothing articles 13. During the drying portion of the cycle, timer 50 energizes motor driven fan 19 while simultaneously returning the operation of basket motor 25 to its normal tumbling activity. Thus, under the urging of fan 19, air is circulated through solvent recovery station 20, drum 11, button trap 17 and is returned to motor driven fan 19. To enhance the operation of the drying cycle, the air passing through solvent recovery station 20 is initially cooled by condensing coil 21 which acts to condense out solvent vapors picked up by the air circulating through drum 11 and carried by the air circulation provided by fan 19. This condensing action cools the passing air and recovers an additional portion of the solvent which is returned to solvent reservoir 40 by coupling means not shown. The cooled circulating air is further moved under the urging of fan 19 through a heat 10 pump coil 22 and steam coil 23. The function of coils 22 and 23 within recovery station 20 is to provide a reheating of the circulating air passing through condensing coil 21. This heated air is more efficient at vaporizing and carrying away residual solvent material still present within clothes 13. This heated air is introduced into drum 11 through inlet 15 and is circulated therethrough as clothes 13 continue to tumble. The heated air having picked up additional solvent from clothes 13 is returned through return duct 16 and button trap 17 to motor driven fan 19 completing the circulation.

In accordance with an important aspect of the present invention, the heated air passing through drum 11 during the drying cycle is subjected to an injection of high temperature steam at the optimum cycle time in accordance with the programming of timer 50. This steam injection is provided by the operation of timer 50 in opening injection valve 63 which permits the flow of high temperature steam outwardly from source 60 through outlet 65, valve 61 and filter 62. The heated steam is injected within drum 11 through one or more nozzles represented by injection nozzle 64 to produce an injected steam flow 64. The steam injection bombards the internal solvent saturated air flow within drum 11 with a stream of water and steam particles to induce a momentary humidity increase within drum 11 which shocks the air therein and improves the saturation environment within drum 11. It has been found that this steam injection provides a substantial improvement in the efficiency of solvent recovery during the drying cycle. It has been further found that the cycle efficiency may be further enhanced by periodic repeated injections of high temperature steam during the drying cycle. The combined steam, water vapor and recovered solvent is carried from drum 11 through exit port 14 through button trap 17 and is driven by fan 19 through condensing coil 21. Once again, the cooling action of coil 21 causes the water vapor and steam as well as the captivated solvent within the circulated air stream to be largely removed as condensation of both solvent and water vapor occurs. This process continues until timer 50 terminates the drying cycle and initiates the portion of the dry cleaning cycle generally referred to as reduction. During reduction, the heating actions of coils 22 and 23 are ceased and circulating air continues as does the tumbling or agitating action upon clothes 13.

In accordance with a further important advantage of the present invention, it has been advantageous to provide one or more steam injections during the reduction or cool down portion of the cycle. Once again, the operation of the steam injection is controlled by timer 50 in accordance with the desired user program. The steam injection provides the above-described bombardment of solvent saturated air flow within drum 11 and once again carries off still further quantities of solvent vapor thereby further increasing the efficiency of solvent recovery of dry cleaning system 10.

Figure 2:
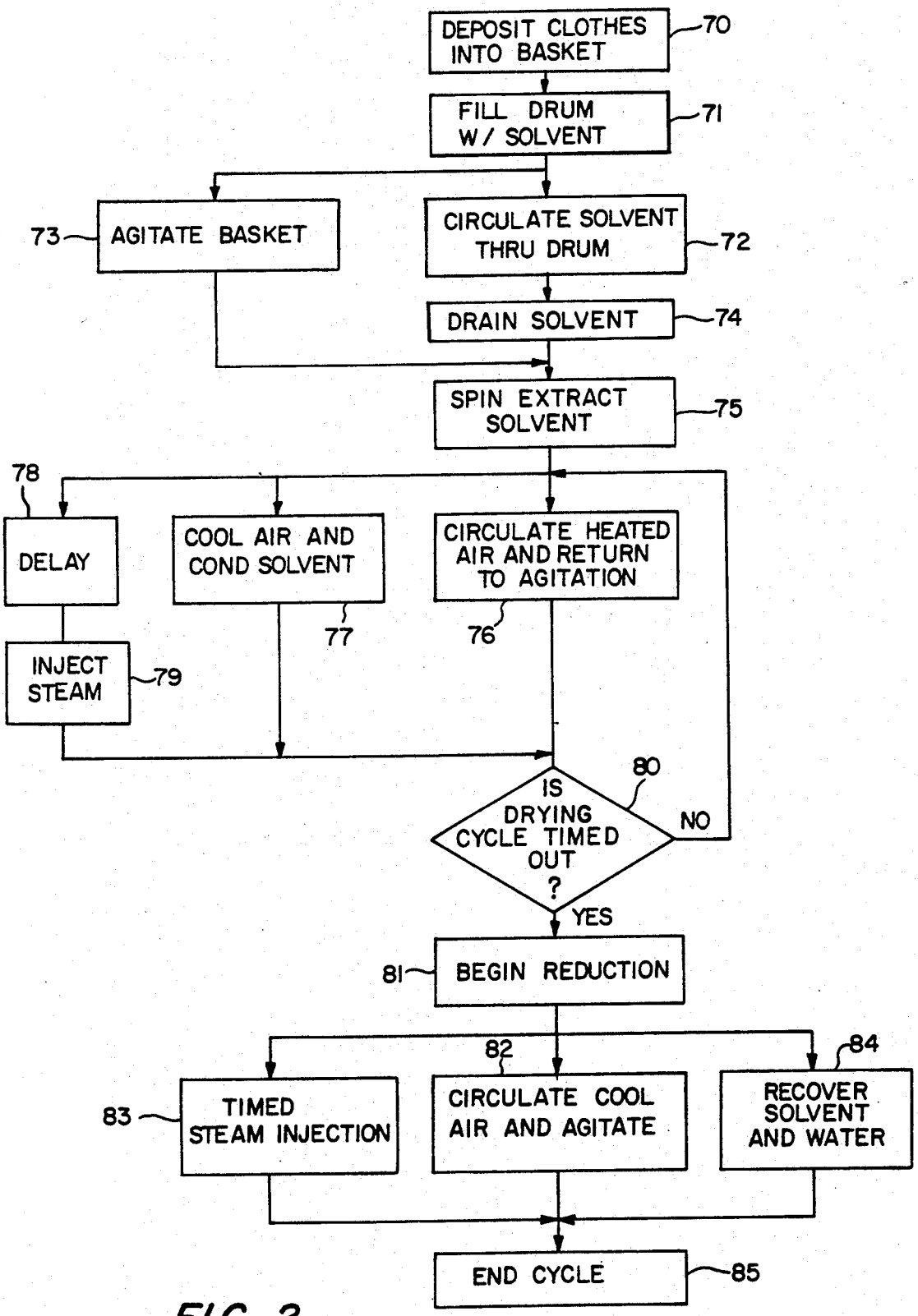
FIG. 2 sets forth a flow diagram of the present invention dry cleaning system and method of operation.

FIG. 2 sets forth a flow diagram of the operation of dry cleaning system 10 in accordance with the present invention method. The dry cleaning cycle is initiated at a step 70 by depositing a quantity of to-be-cleaned clothing articles within the drum basket. Thereafter, the system moves to a step 71 in which solvent is circulated to fill the cleaning drum to the desired level. Next, the system moves to simultaneous steps 72 and 73 in which the cleaning basket is agitated or rotated and in which the solvent is circulated through the cleaning basket and clothing articles therein. Following the solvent circulation, the solvent is drained from the cleaning drum at a step 74. It may be desirable in system operation to maintain the agitation or tumbling operation of step 73 during the solvent draining process of step 74.

Once the solvent has been drained at step 74, the system moves to a spin extraction step 75 in which the cleaning basket is rotated at high speed to provide further solvent extraction. Thereafter, the system moves concurrently to step 76 and step 77. In step 76, heated air is circulated through the drum and drum motion is returned to agitation or tumbling action. At step 77, the circulating air is cooled to provide the above-described condensation of solvent and water vapor thereby enhancing drying action. In addition, the system also implements a predetermined time delay at step 78 afterwhich the system moves to a step 79 in which heated steam is injected into the drum in the manner described above. Thus, steps 76 and 77 continue while the steam injection step 79 is delayed with respect to steps 76 and steps 77 and is periodically operable during the continuing action of steps 76 and 77. As heated air is circulated together with drum agitation and solvent condensation is carried forward and as periodic steam injection cycles take place, the system determines at step 80 whether the drying cycle has timed out. So long as the drying cycle has not been found at step 80 to have timed out, the system continues to operate steps 76, 77, 78 and 79 until a determination is made that drying cycle time has expired. Thereafter, the system moves to a step 81 at which the reduction portion of the dry cleaning cycle is initiated. During the reduction portion of the dry cleaning cycle, the system simultaneously maintains the circulation of cool air and basket tumbling or agitation at step 82, recovers the solvent and water from the circulating cool air at step 84, and provides one or more timed steam injections at step 83. Steps 82 through 84 are maintained simultaneously until the time interval for the reduction portion of the drying cycle expires afterwhich the system moves to a step 85 ending the dry cleaning cycle.

Thus, what has been shown is an increased efficiency dry cleaning system and method which utilizes periodic steam injections during the drying and reduction portions of the dry cleaning cycle to increase the effectiveness of solvent recovery beyond that obtained by prior art systems and methods. It has been found that utilizing the present invention steam injection system significantly reduces solvent emissions during the dry cleaning process. It has been found that solvent vapor levels in the proximity to the dry cleaning equipment both during and after operation with door opening and loading and unloading activities taking place is significantly reduced. It has further been found that garments cleaned using the present invention system and method retain reduced amounts of solvent and thus provide safer work conditions for operating personnel and safer end products for the end user/consumer. In addition, the increased efficiency and greater solvent recovery has been found to decrease solvent consumption for the owner operator which provides significant savings of operating costs attributed to solvent use. Finally, it has been further found that the improved efficiency of the present invention system also reduces the drying cycle process time thereby increasing the through put capacity of the present invention system and method resulting in further savings to the owner operator of the dry cleaning establishment.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A dry cleaning system for use in dry cleaning cloth articles, said dry cleaning system comprising:

a cloth article drum having a movable basket therein;

solvent circulation means for circulating a solvent through said drum;

air circulation means for circulating air through said drum; and steam injection means for intermittently injecting steam into said drum at predetermined times when said air circulation means is operating.

2. A dry cleaning system as set forth in claim 1 wherein said air circulation means includes condensing means for cooling circulating air to condense solvent vapor and water vapor therefrom.

3. A dry cleaning system as set forth in claim 2 wherein said circulation means include heating means for heating circulating air.

4. A dry cleaning system as set forth in claim 3 wherein said air circulation means are operated using both said heating means and said condensation means during a drying operation and wherein said steam injection means are operative at least once during said drying operation.

5. A dry cleaning system as set forth in claim 4 wherein said air circulation means are operated using only said condensing means during a reduction operation and wherein said steam injection means are operative at least once during said reduction operation.

6. A method of dry cleaning cloth articles comprising the steps of:

circulating a cleaning solvent through said cloth articles;

agitating or tumbling said cloth articles in said circulating solvent;

extracting said solvent by spin extraction;

drying said cloth articles by circulating heated air therethrough;

injecting steam into said circulating air proximate said cloth articles during said drying step;

cooling said heated air to condense solvent and water vapors during said drying step; and reducing the temperature of said circulating air and cloth articles following said drying step.

7. The method set forth in claim 6 further including the step of further injecting steam into said circulating air proximate said cloth articles during said reducing step.

8. The method set forth in claim 7 wherein said injecting step includes producing a first plurality of short duration steam bursts.

9. The method set forth in claim 8 wherein said further injecting step includes producing a second plurality of short duration steam bursts.

10. A dry cleaning system for cloth articles comprising:

means for circulating a cleaning solvent through said cloth articles;

means for agitating or tumbling said cloth articles in said circulating solvent;

means for extracting said solvent by spin extraction;

means for drying said cloth articles by circulating heated air therethrough;

means for injecting steam into said circulating air proximate said cloth articles during operation of said means for drying;

means for cooling said heated air to condense solvent and water vapors during operation of said means for drying; and means for reducing the temperature of said circulating air and cloth articles following operation of said means for drying.

11. A dry cleaning system as set forth in claim 10 further including:

means for further injecting steam into said circulating air proximate said cloth articles during operation of said means for reducing.

12. A dry cleaning system as set forth in claim 11 wherein said means for injecting includes means for producing a first plurality of short duration steam bursts.

13. A dry cleaning system as set forth in claim 8 wherein said means for further injecting step includes means for producing a second plurality of short duration steam bursts.

* * * * *